US007784791B2

(12) United States Patent
Perez Cabeza et al.

(10) Patent No.: US 7,784,791 B2
(45) Date of Patent: Aug. 31, 2010

(54) TOY COMPRISING AN IMPROVED THREE-DIMENSIONAL PUZZLE

(75) Inventors: Felix-Abdon Perez Cabeza, Peralta (ES); Aleksandr Ivanovich Marusenko, Pologi (UA)

(73) Assignee: Palcan Y Bin, S.L., Peralta (Navarro) (ES)

( * ) Notice: Subject to any disclaimer, the term of this patent is extended or adjusted under 35 U.S.C. 154(b) by 21 days.

(21) Appl. No.: 11/991,553

(22) PCT Filed: Sep. 7, 2005

(86) PCT No.: PCT/ES2005/000485

§ 371 (c)(1),
(2), (4) Date: Apr. 24, 2008

(87) PCT Pub. No.: WO2007/028837

PCT Pub. Date: Mar. 15, 2007

(65) Prior Publication Data

US 2009/0115132 A1 May 7, 2009

(51) Int. Cl.
*A63F 9/08* (2006.01)
*A63F 9/12* (2006.01)
*A63F 9/06* (2006.01)

(52) U.S. Cl. ..... 273/153 S; 273/153 R

(58) Field of Classification Search ..... 273/153 S, 273/153 R
See application file for complete search history.

(56) References Cited

U.S. PATENT DOCUMENTS 4,344,623 A * 8/1982 Isobe ..... 273/153 S
4,557,484 A 12/1985 Sherman, Jr. et al.
5,074,562 A 12/1991 Green
5,358,247 A * 10/1994 Meffert ..... 273/153 S
5,452,895 A 9/1995 Ray
5,566,941 A 10/1996 Destics
5,816,571 A * 10/1998 Chen ..... 273/153 S
6,244,597 B1 * 6/2001 Matijek ..... 273/153 S
6,769,690 B1 * 8/2004 Khoudary ..... 273/153 S
2005/0269770 A1 * 12/2005 Mak ..... 273/153 R

FOREIGN PATENT DOCUMENTS

EP 0 522 223 1/1993
ES 261408 5/1982
ES 8500077 1/1985
ES 281335 10/1985

(Continued)

OTHER PUBLICATIONS

International Search Report issued Mar. 9, 2006 in the International (PCT) Application of which the present application is the U.S. National Stage.

*Primary Examiner*—Gene Kim
*Assistant Examiner*—Joseph B Baldori
(74) *Attorney, Agent, or Firm*—Wenderoth, Lind & Ponack, L.L.P.

(57) ABSTRACT

The invention relates to a toy comprising an improved three-dimensional puzzle, which essentially comprises a base body and a plurality of three-different types of elements which are mounted to the base body, whereby groups of elements can be rotated in order to form the desired toy. In this way, the elements of the toy can be controlled simply and conveniently, while optimum stability and strength are obtained.

7 Claims, 8 Drawing Sheets

FOREIGN PATENT DOCUMENTS

| | | |
|---|---|---|
| ES | 1 025 710 | 1/1994 |
| ES | 2 218 479 | 11/2004 |
| FR | 2 723 853 | 3/1996 |
| GB | 2 088 728 | 6/1982 |
| RU | 2 064 315 | 7/1996 |
| SU | 1136820 | 1/1985 |
| SU | 1618432 | 1/1991 |
| WO | 00/72929 | 12/2000 |
| WO | 2004/030776 | 4/2004 |

* cited by examiner

TOY COMPRISING AN IMPROVED THREE-DIMENSIONAL PUZZLE

BACKGROUND OF THE INVENTION

As stated in the title of this descriptive specification, the following invention relates to a toy comprising an improved three-dimensional puzzle, these improvements being incorporated into the object claimed in Patent WO 2004/030776, the toy essentially comprising a base body and a plurality of three different types of elements which are mounted to the base body, whereby groups of elements can be rotated in order to form the desired toy. In this way, the elements of the toy can be controlled simply and conveniently, while optimum stability and strength are obtained.

To achieve this, the base body is defined by two concentric spheres between which are arranged some channel shaped recesses for the mounting is of some first elements among the set of elements, and with respect to which first elements some second elements are mounted, in order to complete the assembly with the insertion of a third type of unit element.

The present specification describes certain improvements of application in a three-dimension puzzle consisting of a base body and a set of elements according to three different types, being of special application for its incorporation into the object of patent WO 2004/030776.

Among the existing prior art we can cite the actual documents cited in the search report for patent WO 2004/030776, which makes reference to documents RU 2064315, SU 1136820, U.S. Pat. No. 5,452,895 and SU 1618432, all of them being regarded as belonging to the prior art.

We can likewise consider document RU 1452535 already cited in patent WO 2004/030776.

Moreover, patent WO 2004/030776 describes a puzzle, of general hollow spherical shape, based on certain elements according to two types, said elements being formed when the sphere is dissected by means of three planes perpendicular to its vertical axis and, moreover, dissecting the sphere by three planes perpendicular to a first horizontal axis and by another three planes perpendicular to a second horizontal axis perpendicular to the first.

In this way, the elements obtained in a first and second type are joined together by means of a third element of attachment.

SUMMARY OF THE INVENTION

The present specification describes a toy comprising an improved three-dimensional puzzle, these improvements being incorporated into the object claimed in Patent WO 2004/030776, the toy comprising a base body and a set of elements that can be mounted to the base body, the set of elements being mounted with the possibility of displacement according to groups of elements in order to create the desired toy, in such a way that the three-dimensional puzzle comprises:

a base body defined by two concentric spheres sectioned by three pairs of planes in the separation zone between them, the planes of each pair being parallel and the three pairs of planes being orthogonal to each other and not passing through the geometric centers of the spheres, creating certain openings that are prolonged internally in some recesses perimetric to those openings, which define some channel-shaped recesses between both spheres, the imaginary outer sphere being constituted by four surfaces, three of them being equal and the fourth surface, different and of larger size, has a hole in its central position that passes through with respect to the inner sphere;

a plurality of first elements, seven in number, each defined by a body with a substantially triangular plan view, with its curvo-concave sides having a projection in relation to its lower part, the upper central part of its three lateral projections presenting a recess in relation to which there is a lug projecting out that ends in a circular shape with its upper surface curvo-convex, while in the central part of its inner surface there is a cylindrical projection ending in a trunco-conical portion.

a plurality of second elements, twenty-four in number, each defined by a body with a substantially triangular plan view, with two equal sides orthogonal to each other and the third side curvo-convex, the curvo-convex lateral side having a slot and the upper surface of the slot having a pair of small central projections which between them define a curvo-concave cavity;

a third unit element defined by a body with a substantially triangular plan view with its curvo-concave sides having a projection in relation to its lower part, its vertices having a recess in relation to which there is a lug projecting from the inside out, which ends in a circular shape with its outer surface curvo-convex, while in the central part of its inner surface there is a projection consisting of two independent and neighbouring rods which define a triangular section, one of the end sides of a rod ending in a projection with a triangular section.

The three equal surfaces constituting the outer sphere have a substantially triangular plan view with two sides orthogonal and the third curvo-convex and the fourth side constituting the outer sphere has a substantially triangular plan view and the hole, of triangular section, passing through its central part and ending in separate recesses on its three sides.

So, in the assembly of the first elements in the base body, the trunco-conical portion fits via the openings defined between the concentric spheres, remaining positioned in the channel-shaped recesses present between the spheres.

Moreover, in the assembly of the second elements, fitting into the slot of their curvo-convex side is the respective projection of the lateral lower part of one of the first elements, the inner surface of the second element remaining backed onto a surface relative to the outer sphere of the base body.

Likewise, in the assembly of a second element with a first element, the respective lateral projection of the first element remains fitted between the pair of small central projections of the upper surface defined by a slot present in the curvo-convex side of the second element, acting as a brake and facilitating its static positioning.

The closure of the toy is carried out, first, by fitting respective second elements into the projections of the lateral sides of the third unit element, and second, by fitting into the passing hole, of triangular section, of the larger size surface constituting the outer sphere of the base body, the projection consisting of the double rod, of similar general triangular section.

So, the projection of triangular section, provided at the end of one of the rods of the projection of the lower surface of the unit body of the third type, fits into the respective recess in the passing hole of the base body, while the circular endings and curvo-convex outer surface of the projecting lugs, relative to the vertices of the third unit element, in their assembly, remain embedded in respective small depressions of the respective vertex of a first element backed on to it.

In order to complement the description to be made forthwith, and with the aim of aiding a better understanding of the characteristics of the invention, this descriptive specification is accompanied by a set of drawings containing figures in which, on an illustrative rather than limiting basis, the most characteristic details of the invention are represented.

BRIEF DESCRIPTION OF THE DESIGNS

DESCRIPTION OF A PREFERRED EMBODIMENT

With the figures in view and according to the adopted numbering we can seen how the toy 1 consists of a plurality of pieces in accordance with three types of different elements which are mounted on a base body, representing an improvement on the toy claimed in Patent WO 2004/030776.

Figure 1:
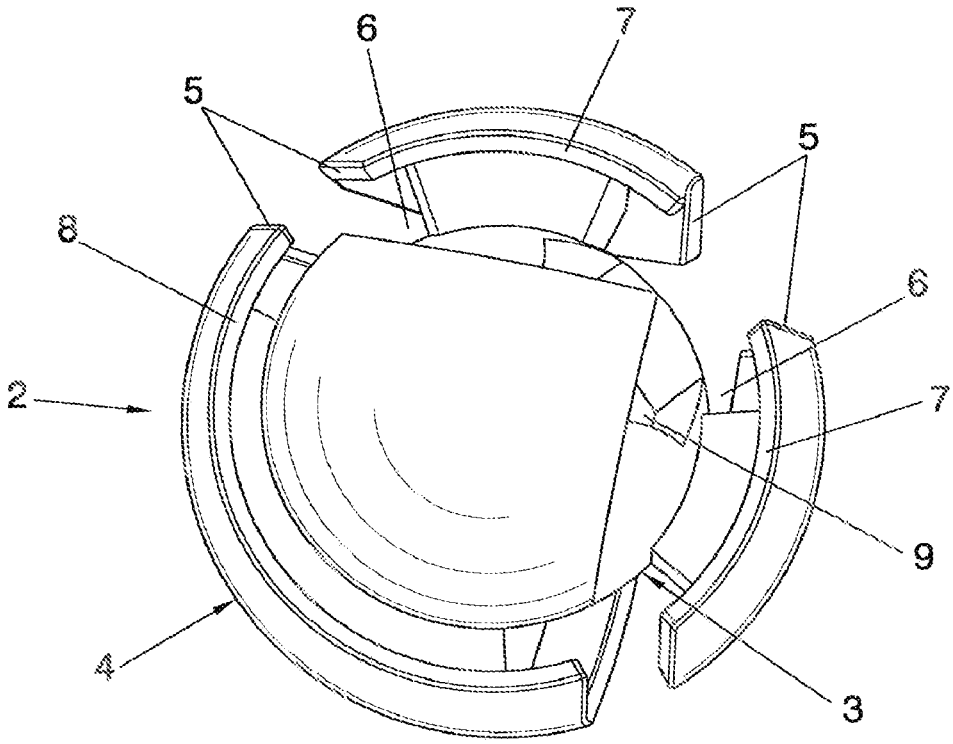
FIG. 1 shows a first view of a base body of a three-dimensional puzzle, where the outer front shape can be seen of one of the surfaces constituting an outer sphere, along with channel-shaped recesses defined between concentric spheres.
Figure 2:
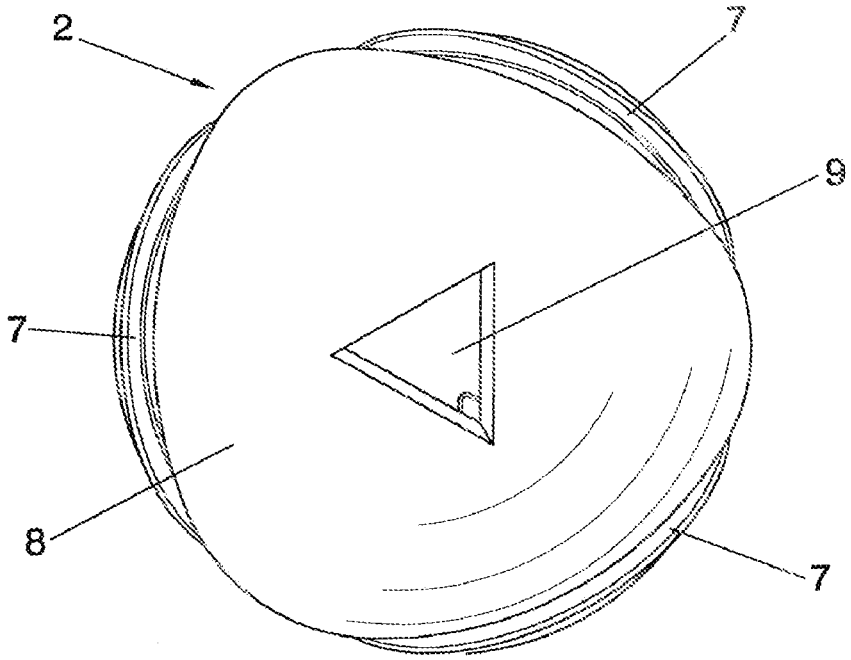
FIG. 2 shows a second view of the base body of the three-dimensional puzzle, where the larger size surface of the outer sphere with a central passing hole can be seen.

So, the three-dimensional toy 1 comprises a base body 2 defined by two concentric spheres 3 and 4 sectioned, a zone of separation between them, by three pairs of planes, the planes of each pair being parallel and the three pairs of planes being orthogonal to each other and decentered (i.e., not passing through the geometric centers of the spheres), as can be seen in FIG. 1.

In this way, some openings 5 are created prolonged internally in some perimetric recesses defining some channel-shaped recesses 6 between the two spheres, with the imaginary outer sphere 4 consisting of four surfaces, three of those surfaces 7 being equal and of substantially triangular plan view with two sides orthogonal to each other and the other curvo-convex, while the fourth surface 8 that is defined has a substantially triangular plan view and is larger than the surfaces 7.

So, the surfaces 7 and 8 constituting the outer sphere remain attached to the inner sphere by respective attachment points 10 between which the channel-shaped recesses 6 have been defined.

Figure 3:
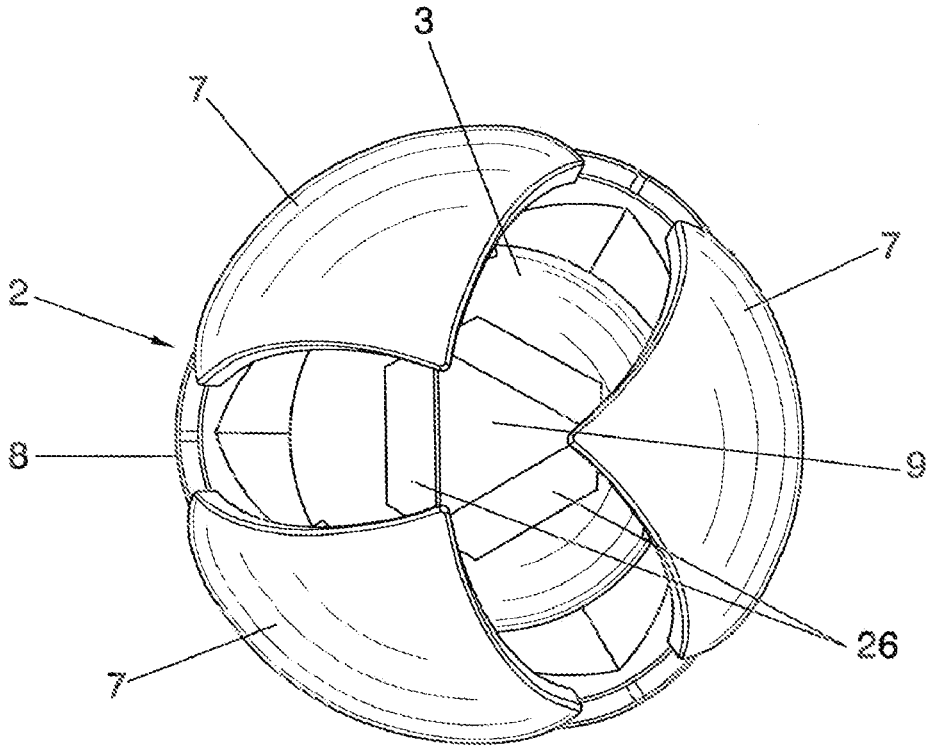
FIG. 3 shows a third view of the base body of the three-dimensional puzzle, where the passing hole of triangular section can be seen ending in the inner sphere in its three sides according to separate recesses.
Figure 4:
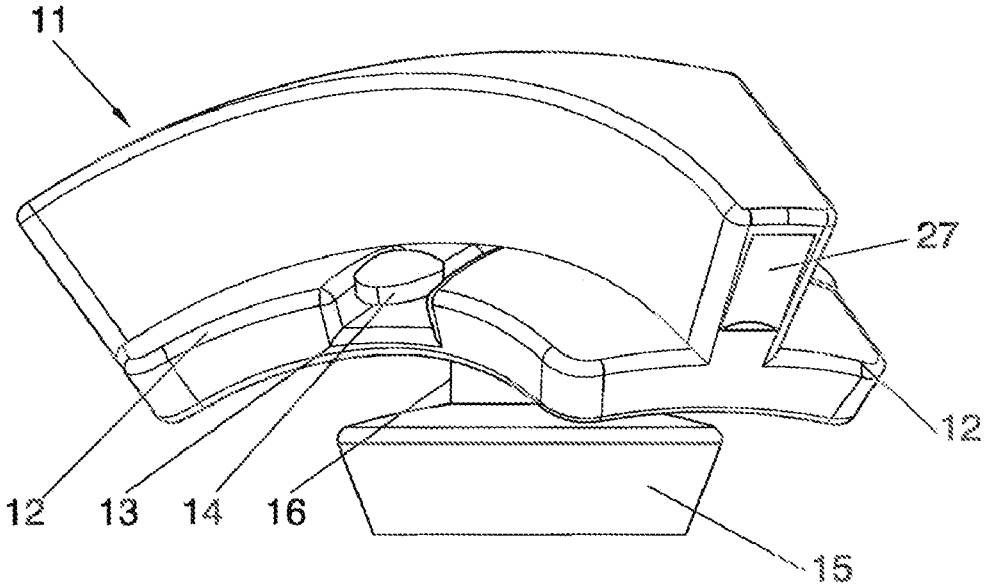
FIG. 4 shows a view in side elevation of a first mounting element in the base body of the puzzle, where lower lateral projections and a projection of its inner surface can be seen.
Figure 5:
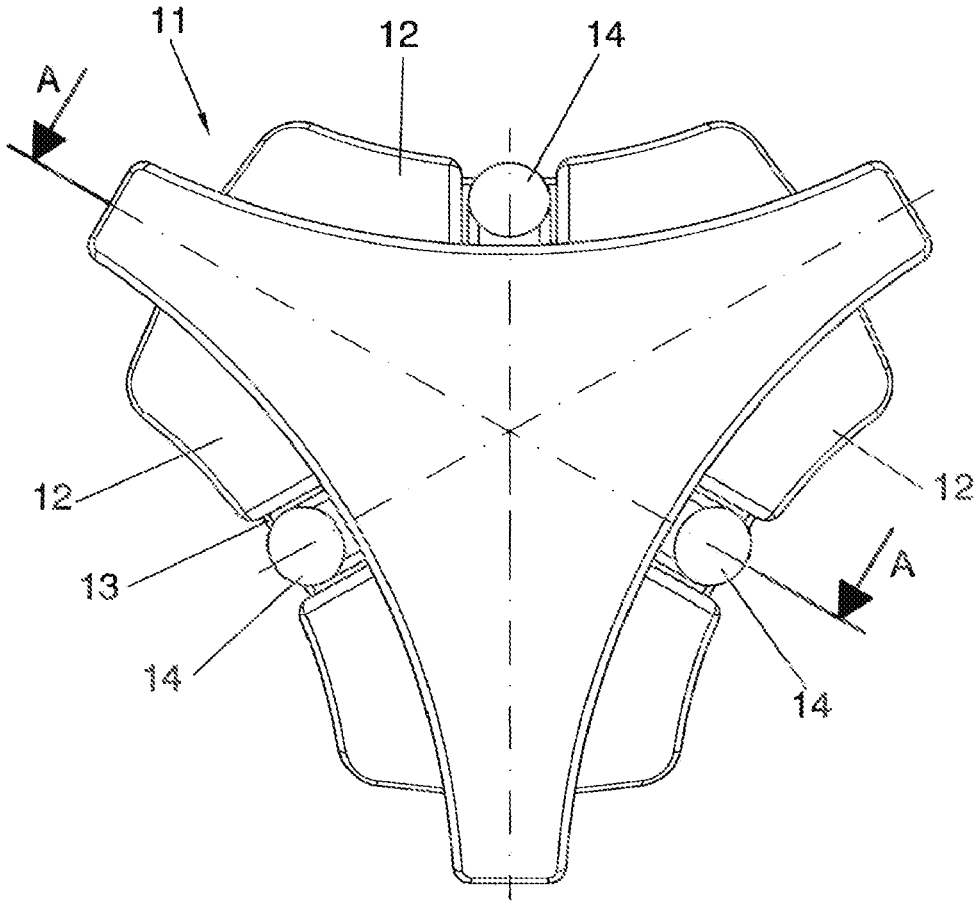
FIG. 5 shows a plan view of the first mounting element of FIG. 4, where its substantially triangular form of curvo-concave sides can be seen with some projections below them, which projections have a central recess and a lug projecting out in relation to it.
Figure 6:
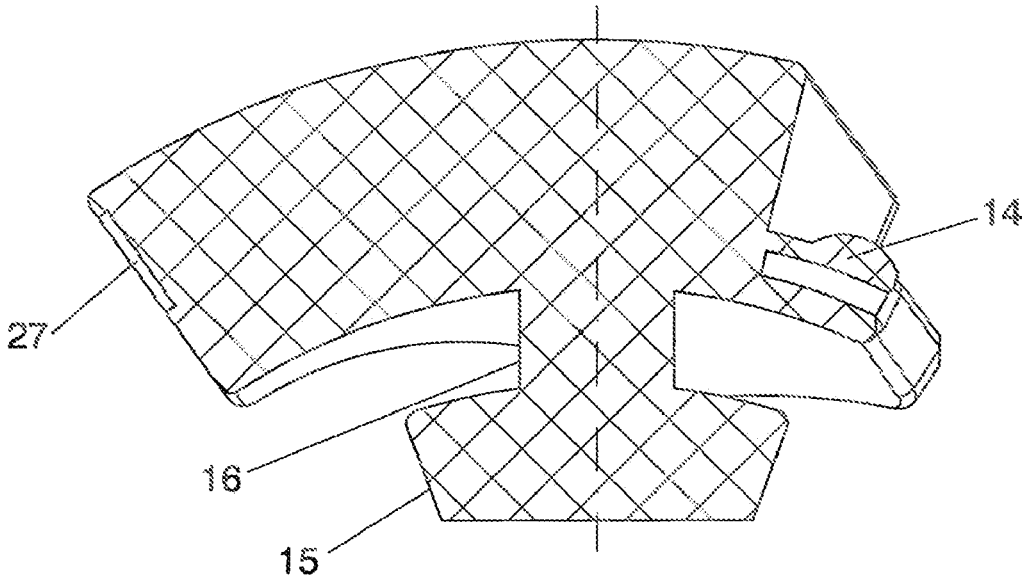
FIG. 6 shows a sectioned view along the line A-A of FIG. 5.
Figure 7:
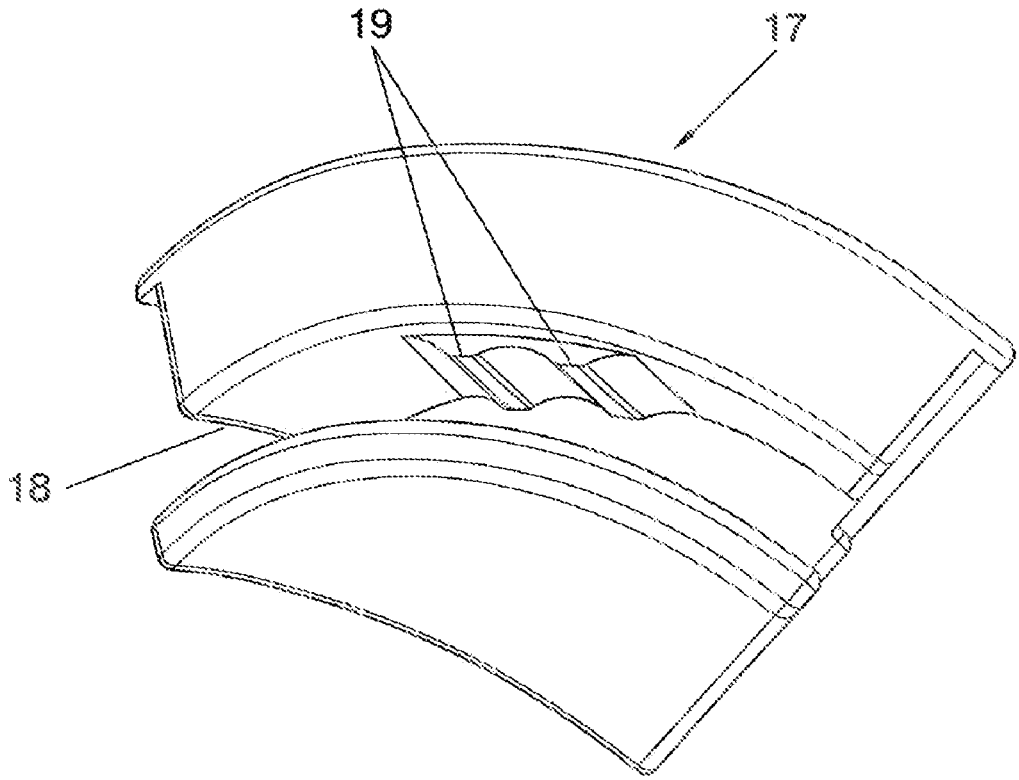
FIG. 7 shows a perspective view of a second element making up the puzzle, which has a substantially triangular shape in plan view with two sides orthogonal to each other and a third side curvo-convex in which there is a slot, with two small central projections having been defined in the upper surface thereof.
Figure 8:
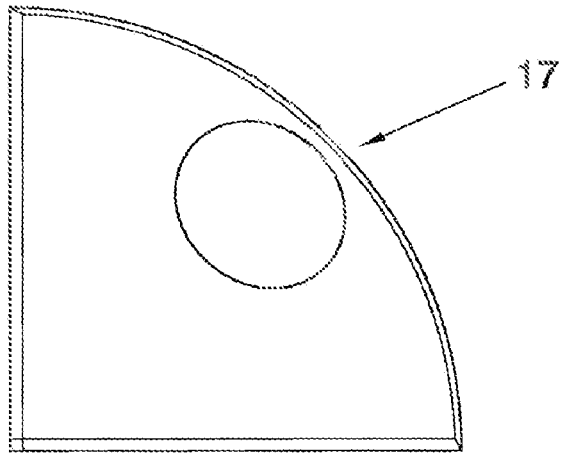
FIG. 8 shows a plan view of the second element of FIG. 7.
Figure 9:
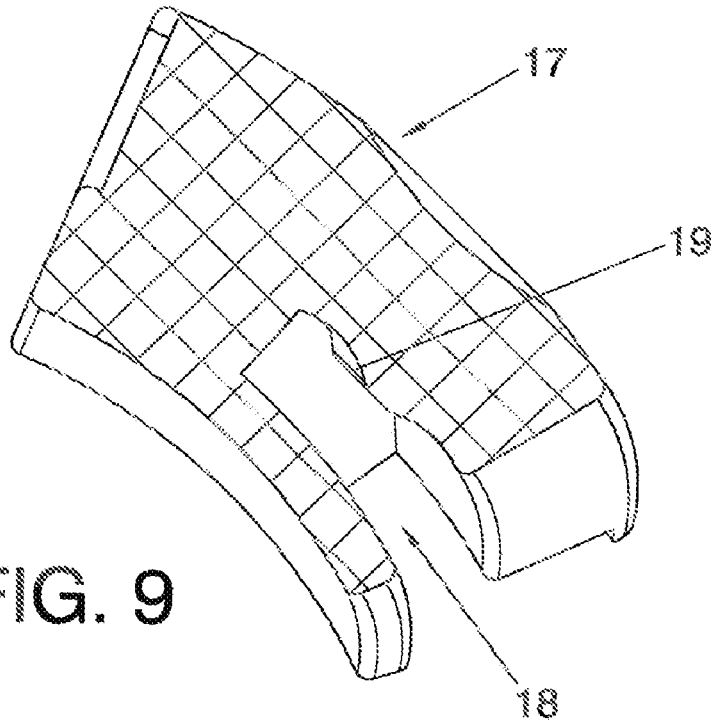
FIG. 9 shows a sectioned view of the element of FIG. 8, where the slot of its curvo-concave side can be seen, along with a small projection of the upper surface which defines that slot.
Figure 10:
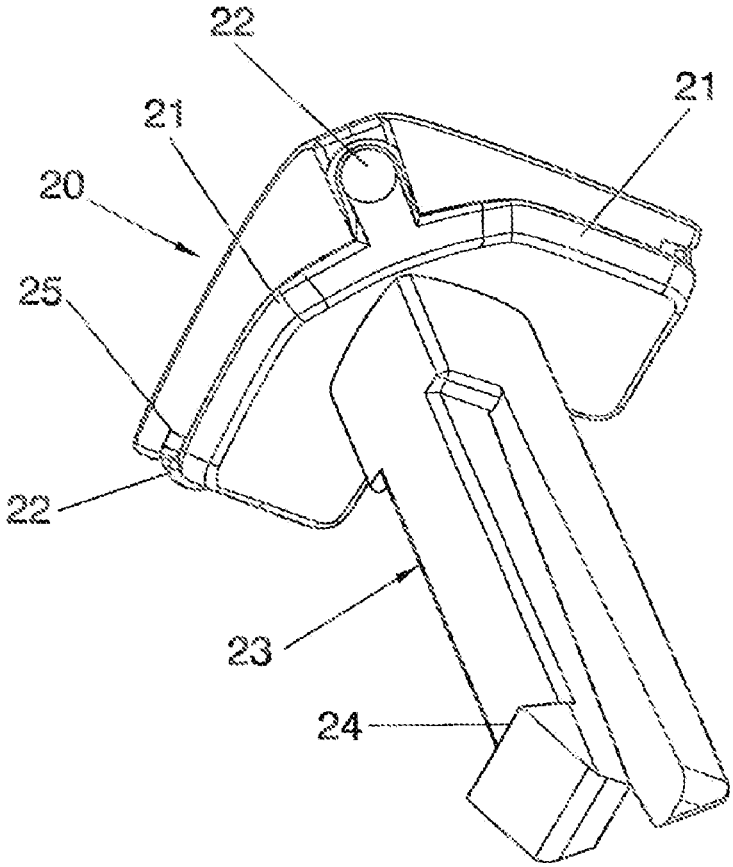
FIG. 10 shows a perspective view of a unit element of the third type creating the puzzle, which has a substantially triangular plan view with curvo-concave sides and, in its inner concave surface, it has a projection constituted by two rods, which between them have a substantially triangular section.
Figure 11:
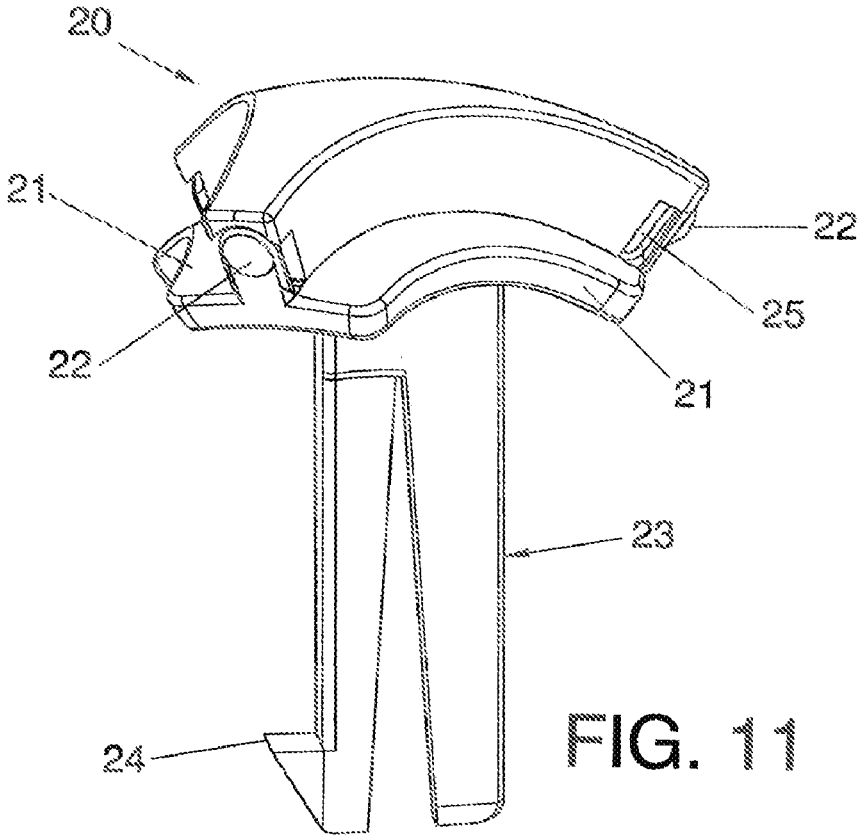
FIG. 11 shows a view in side elevation of the third type of unit element creating the puzzle, where the projection formed by two rods can be seen, which between them have a substantially triangular section.
Figure 12:
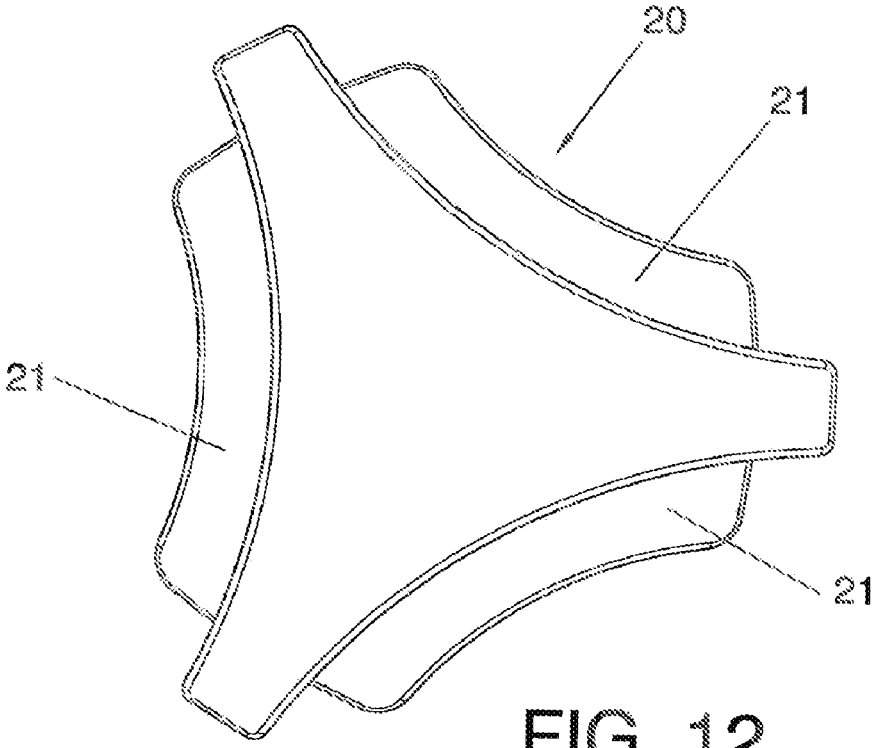
FIG. 12 shows a view in upper plan of the third type of unit element of FIG. 10, where the projections of the lower part of its three curvo-concave sides can be seen.
Figure 13:
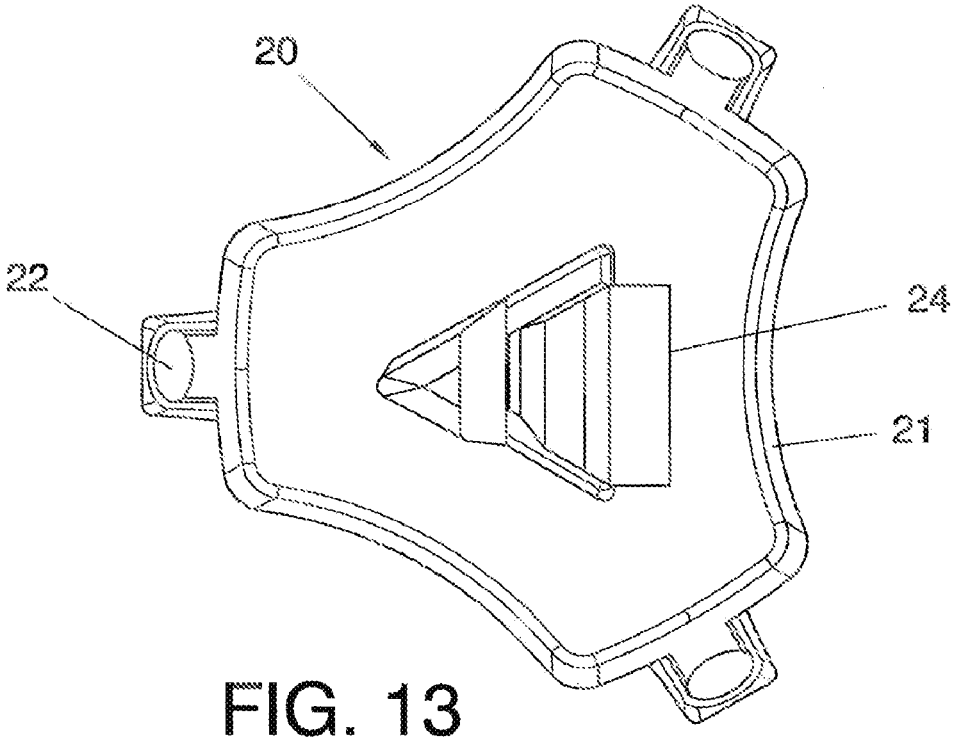
FIG. 13 shows a view in lower plan of the third type of unit element of FIG. 10, where the projections of the lower part of its three curvo-concave sides can be seen, along with the projections formed by two rods.

The larger-size surface 8 constituting the outer sphere 4 has in its central part a hole 9 of triangular section passing through to the opposite part of the inner sphere 3 and ending in separate recesses 26 in its three sides, as can be appreciated in FIG. 3.

So, in the design of the puzzle, a diversity of elements are fitted into the base body 2 according to three different types, this diversity of elements having rotational movement according to different groups of elements.

In this way, a plurality of first elements 11, seven in number, are each defined by a body of substantially triangular plan view with its curvo-concave sides provided in relation to its lower part with a projection 12.

Likewise, the projections 12 of the lateral sides of the first elements 11 have in their central part a recess 13 in relation to which it has projecting out from it a lug 14 ending in a circular shape with its upper surface curvo-convex.

Likewise, in the central part of the inner surface, the first elements 11 each have a cylindrical projection 16 ending in a trunco-conical portion 15.

Equally, the toy 1 comprises a plurality of second elements 17, twenty-four in number, which are each defined by a substantially triangular plan view body with two sides equal and orthogonal to each other and the third side being curvo-convex, having a slot 18 in the lateral curvo-convex side and having in the upper surface of the slot 18 a pair of small central projections 19 between which is defined a cavity with a concave surface.

Finally, the toy 1 comprises a third unit element 20 defined by a substantially triangular plan view body with its curvo-concave sides provided with a projection 21 in relation to its lower part, having a recess 25 in its vertices in relation to which it has respective lugs 22 projecting from the inside out, ending in a circular shape and with a curvo-convex outer surface.

This third unit element 20 likewise has a projection 23 in the central part of its inner surface, this projection 23 consisting of two rods which together define a substantially triangular section, with one of the rods ending at its free end in a projection 24 of triangular section.

Starting from this structuring in the assembly of the first elements 11 in the base body 2, the trunco-conical portion 15 fits through the openings 5 defined between the concentric spheres 3 and 4, remaining positioned in the channel-shaped recesses 6 present between the two spheres.

Next, the assembly of the second elements 17 takes place, for which fitting into the slot 18 of its curvo-convex side is the respective projection 12 of the lower lateral part of one of the first elements 11 with the inner surface of the second element 17 being left backing on to a surface 7-8 relative to the outer sphere 4 of the base body 2.

So, in the assembly of a second element 17 with a first element 11, the lug 14 projecting out from the respective side of the first element 11 fits between the pair of small central projections 19 of the upper surface defined by the slot 18 present in the curvo-convex side of the second element 17, acting as a brake in the positioning of certain elements with respect to others.

Finally, the closure of the toy is carried out, first, by fitting respective second elements 17 onto the lateral projections 21 of the unit element 20, and second, by fitting the projection 23 consisting of the two rods, of similar general triangular section, into the hole 9, of triangular section, passing through the larger size surface constituting the outer sphere 4 of the base body 2.

Moreover, the circular endings and curvo-convex outer surface of the projecting lugs 22, relative to the vertices of the third unit element 20, in their assembly, remain embedded in respective small depressions 27 of the respective vertex of a first element 11 backed on to it.

Figure 14:
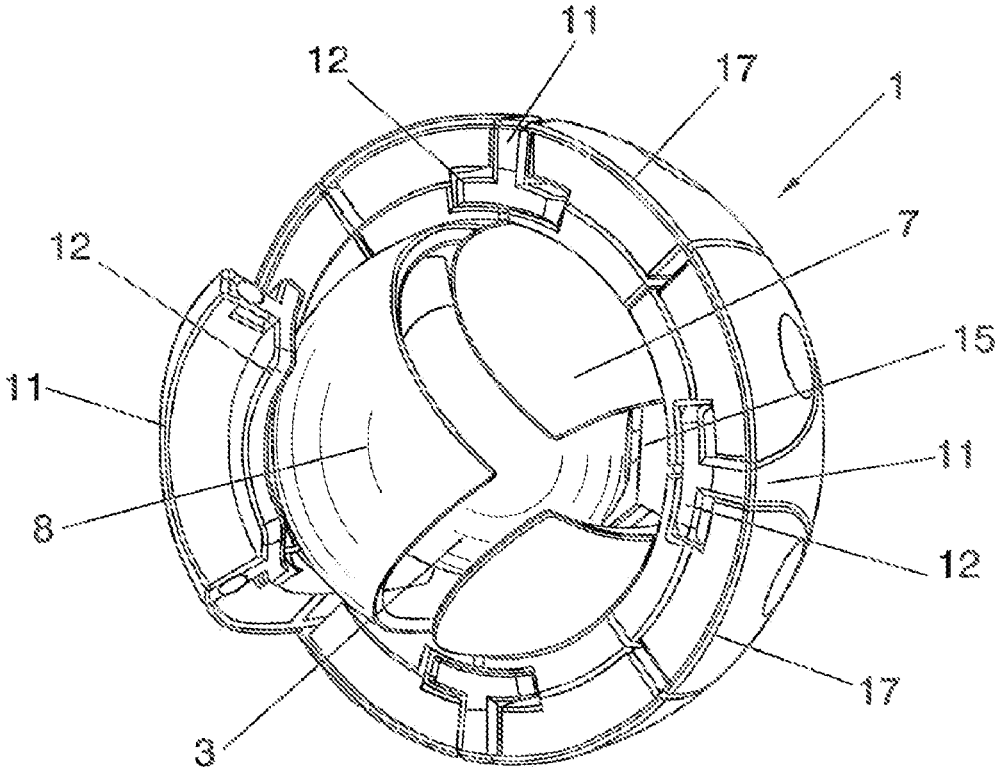
FIG. 14 shows a partial sectioned view of the puzzle, where the assembly of the different elements in their mounting on the base body can be seen.

In FIG. 14 it can be seen how the mounting is carried out of the various elements 11 of the first type and of the elements 17 of the second type on the base body 2, and it can be seen how the trunco-conical portion 15 of the first type of element 11 remains embedded in the respective channel 6 defined between the spheres 3 and 4.

Likewise, it can be seen how the second type of elements 17 are assembled with the first type of elements 11 remaining with their inner surface backing on to one of the constituent surfaces 7 or 8 of the outer sphere.

Figure 15:
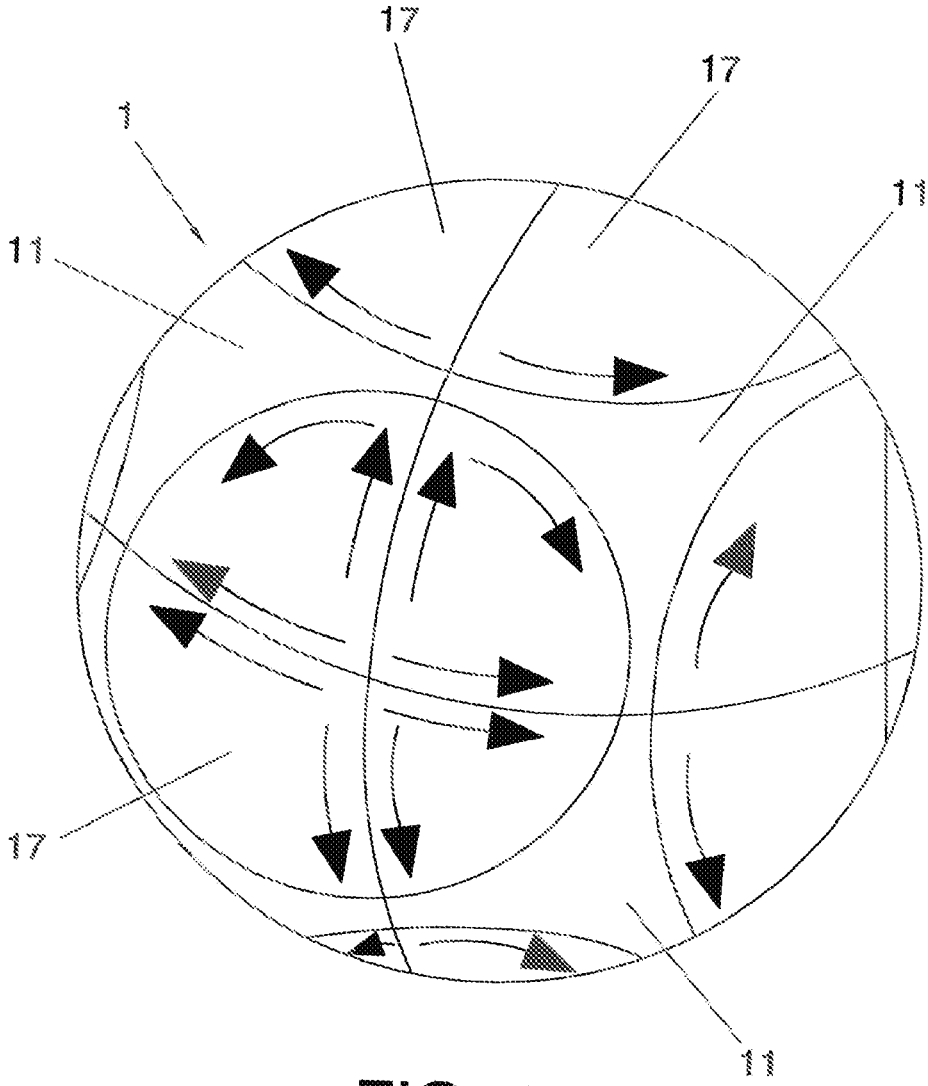
FIG. 15 shows a perspective view of the three-dimensional puzzle mounted, where the external shape of the elements making up the toy can be seen and the different rotational movements are indicated.

Equally, in FIG. 15 we can see the different movements, by groups of elements, which will be able to be made once the toy has been mounted.

We claim:

1. A Toy comprising an improved three-dimensional puzzle, the toy comprising a hollow base body and a plurality of different elements that are configured for assembly on the hollow base body, with possibility of relative displacement in order to create the desired toy, wherein the three-dimensional puzzle (1) comprises:

a base body (2) including two concentric spheres (3, 4) divided by separation zones, and also divided by three pairs of planes, the planes of each pair of planes being parallel to each other, and the three pairs of planes being orthogonal to each other such that none of the planes passes through a geometric center of said concentric spheres, so as to create openings (5) that extend internally of an outer sphere (4) of said concentric spheres with channel-shaped perimetric recesses (6) being defined between said concentric spheres, wherein said outer sphere is constituted by four surfaces including first, second, and third surfaces (7) that are alike and a fourth surface (8) that is different and larger than said first, second, and third surfaces, and wherein a hole (9) is formed through a central portion of said fourth surface of said outer sphere and extends through an inner sphere (3) of said concentric spheres;

a plurality of first elements (11), seven in number, each of said first elements being defined by a first body that, in plan view, is substantially triangular and has three curvo-concave sides, said curvo-concave sides respectively having three lateral projections (12) at lower portions thereof, and each of the three lateral projections having a recess (13) therein with an upwardly projecting lug in said recess, said lug having, in plan view, a circular-shaped end and having a curvo-convex upper surface, each of said first elements being further defined by a cylindrical projection (16) projecting from a central part of a lower surface of the first body and terminating in a trunco-conical portion (15);

a plurality of second elements (17), twenty-four in number, each of said second elements being defined by a second body that, in plan view, is substantially triangular with two equal sides that are mutually orthogonal and a third side that is curvo-convex, said third side having a slot (18) therein defined between upper and lower slot surfaces, said upper slot surface having a pair of small central projections (19) defining a curvo-concave cavity therebetween; and a third element (20) defined by a third body that, in plan view, is substantially triangular and has three curvo-concave sides and three vertices, said curvo-concave sides respectively having three lateral projections (21) at lower portions thereof, and said vertices respectively having recesses (25) with lugs (22) projecting out, each of said lugs having a circular-shaped end with a curvo-convex end surface, said third element being further defined by a projection (23) projecting from a central part of a lower surface of the third body and constituted by two adjacent rods that are respectively substantially triangular in section, a triangular projection (24) being formed at an end portion of one of said two adjacent rods.

2. The Toy comprising an improved three-dimensional puzzle, according to claim 1, wherein each of said first, second and third surfaces of said outer sphere (4) of the base body (2) is, in plan view, substantially triangular with two sides that are orthogonal to each other, and a third side that is curvo-convex;

wherein said fourth surface (8) of said outer sphere (4) is, in plan view, substantially triangular; and wherein the hole (9) formed through said fourth surface of said outer sphere is triangular in section so as to have three sides, and terminates in separate recesses (26) on the three sides thereof.

3. The Toy comprising an improved three-dimensional puzzle, according to claim 2, wherein said first, second, and third elements are configured such that, in assembly of said third element with said base body (2):

said projection (23) constituted by said two adjacent rods is received in said hole (9) formed through said fourth surface (8) of said outer sphere and extending through said inner sphere, and said second elements (17) are respectively engaged with said projections (21) of said third element (20);

said triangular projection (24) is fitted in one of the separate recesses (26); and said projecting lugs (22) of said third element (20) are respectively embedded in small depressions (27) formed in respective vertices of respective ones of the first elements (11), so as to result in closure of said three-dimensional puzzle toy (1).

4. The Toy comprising an improved three-dimensional puzzle, according to claim 1, wherein said first, second, and third elements are configured such that, in assembly of said first elements (11) with said base body (2), the trunco-conical portions (15) of the first elements respectively fit through the openings (5) defined between the concentric spheres (3, 4) so as to remain positioned in said channel-shaped recesses (6).

5. The Toy comprising an improved three-dimensional puzzle, according to claim 4, wherein said first, second, and third elements are configured such that, in assembly of said second elements (17) with said base body (2), said lateral projections (12) of said first elements are respectively fitted into said slots (18) of said second elements such that a lower surface of each of said second elements remains backed on to one of said first, second, third, and fourth surfaces (7, 8) of said base body.

6. The Toy comprising an improved three-dimensional puzzle, according to claim 1, wherein said first and second elements (11, 17) are configured such that, in fitting of said lateral projections (12) of said first elements into said slots (18) of said second elements, respectively, said projecting lugs (14) of said lateral projections (12) of said first elements (11) remain fitted between respective pairs of said small central projections (19) of said second elements.

7. The Toy comprising an improved three-dimensional puzzle, according to claim 1, wherein said first, second, and third elements are configured such that, in assembly of said third element with said base body (2), said projection (23) constituted by said two adjacent rods is received in said hole (9) formed through said fourth surface (8) of said outer sphere and extending through said inner sphere, and said second elements (17) are respectively engaged with said projections (21) of said third element (20), so as to result in closure of said three-dimensional puzzle toy (1).

* * * * *